United States Patent [19]

Debaigt

[11] 4,111,517

[45] Sep. 5, 1978

[54] JUNCTION BLOCK WITH TWO FIXING ORIENTATIONS

[75] Inventor: Jean Debaigt, Maisons Laffitte, France

[73] Assignee: Cgee Alsthom, Levallois-Perret, France

[21] Appl. No.: 837,979

[22] Filed: Sep. 29, 1977

[30] Foreign Application Priority Data

Oct. 15, 1976 [FR] France ..... 76 31142

[51] Int. Cl.[2] ..... H01R 9/22

[52] U.S. Cl. ..... 339/198 GA

[58] Field of Search ..... 339/198 R, 198 G, 198 GA, 339/32 R, 128, 125 R, 125 L; 248/27.3

[56] References Cited

U.S. PATENT DOCUMENTS

| | | | |
|---|---|---|---|
| 2,424,757 | 7/1947 | Klumpp, Jr. | 339/128 |
| 3,958,857 | 5/1976 | Schultz et al. | 339/128 |

*Primary Examiner*—Neil Abrams

*Attorney, Agent, or Firm*—Sughrue, Rothwell, Mion, Zinn and Macpeak

[57] ABSTRACT

The junction block has four resilient fixing legs disposed in pairs about both of two fixing orientations of the block. Each leg has a lock notch facing the adjacent fixing legs and designed to catch under a support strip edge when the block is in position. The legs cam resiliently apart during fixing and the lock notches snap into position when the block is pushed home far enough.

8 Claims, 2 Drawing Figures

JUNCTION BLOCK WITH TWO FIXING ORIENTATIONS

FIELD OF THE INVENTION

The invention relates to a junction block including a device for elastic fixing the block to the parallel edges of a support.

BACKGROUND OF THE INVENTION

Generally, junction blocks are provided to be fixed in line, side by side on a supporting sectional part with parallel edges so as to form a connection bar. But in some cases, it has appeared that with some types of block, more particularly those having rows of terminals arranged in line and crosswise, that it would be advantageous to be able to install them optionally in two orthogonal directions, i.e. either with an in-line installation or with a crosswise installation.

Preferred embodiments of the invention provide a junction block having a fixing device allowing easy fixing thereof in orthogonal directions between the parallel edges of a same support.

SUMMARY OF THE INVENTION

The invention provides a junction block having two orthogonal fixing orientations in relation to a support having parallel edges, the block comprising a molding of plastics material including four resilient fixing legs integrally molded with the block and disposed symmetrically in pairs about both of the fixing orientations of the block, each leg having a lock notch facing each of the adjacent fixing legs and being designed to be applied under one of the edges of the support after resilient deflection of the legs from the edges during application of the block to the support.

Preferably the block further comprises a stop facing each lock notch and arranged to bear against said edge of the support. This stop can be the base of the block.

The fixing legs may be recessed behind the planes of sides of the block, and the ends of the legs may be ramped to cause the legs to be cammed apart during fixing of the block to the support, the lock notches snapping under their edges when the block is pushed far enough home.

The characteristics and advantages of the invention will become apparent from the description of an embodiment given hereinbelow by way of an example and illustrated in the accompanying drawing.

DESCRIPTION OF THE PREFERRED EMBODIMENT

Figure 1:
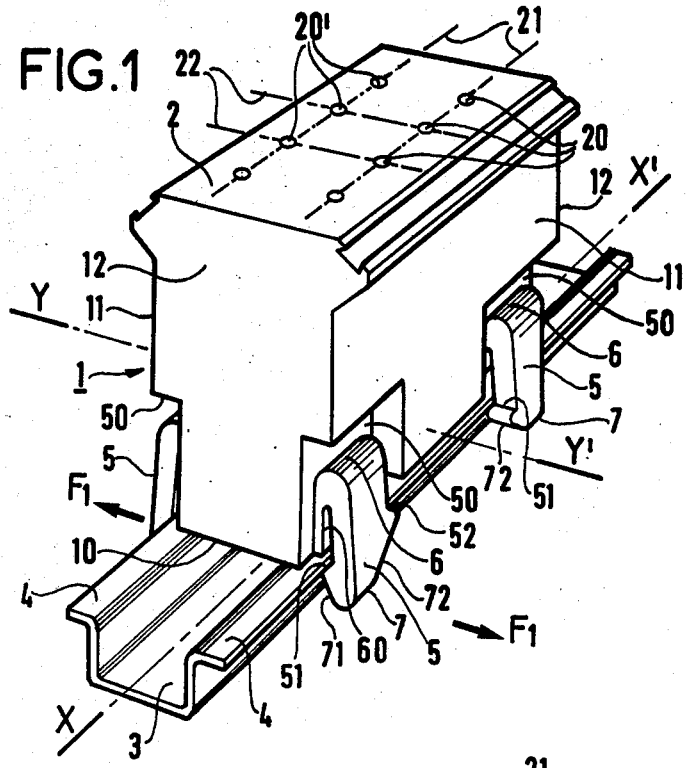
FIG. 1 is a schematic perspective view of a junction block embodying the invention, for installation in line on a support.

In the figures, the reference numeral 1 designates a junction block having substantially the shape of a rectangular parallelepiped. Connection terminals such as 20 and 20' are disposed on the top surface 2 of the block 1. The sets of connection terminals 20 and 20' constitute rows 21 of terminals in line, whereas the adjacent terminals 20 and 20' taken in pairs constitute rows 22 of terminals in columns.

The junction block includes on the opposite surface or base 10 to the top surface 2, and has two opposite lateral surfaces 11 and two other opposite lateral surfaces 12. The surfaces 11 constitute the longitudinal surfaces and the surfaces 12 constitute transversal faces.

The junction block 1 can be fixed on a support 3 constituted by a metallic terminal strip having parallel edges 4, its base 10 abutting against the edges 4.

For this purpose, the junction block has on each of its longitudinal surfaces 11 two fixing legs 5 each comprising towards its end 7 a lock notch 51 parallel to the longitudinal plane of symmetry of the junction block about the line XX' and a lock notch 52 parallel to the transversal plane of symmetry of the junction block about the line YY'. These fixing legs 5 are moulded in the plastics material of the junction block. They are disposed parallel to the longitudinal surfaces 11 in recesses 50 of the junction block so that they are backed off with respect to the most protruding parts of the lateral surfaces.

The legs are connected to the junction block by a folded part which is rounded so as to provide a slot 60 open towards the base 10 of the block.

The extreme end 7 is connected to the lock notches 51 and 52 respectively by ramps 71 and 72.

The junction block operates as follows:

For the in-line installation of the junction block, the base 10 is disposed above the support 3, the longitudinal plane of symmetry about the line XX' being parallel to the edges 4. The block is then pushed onto the support 3 so that the engaging ramps 71 come into contact with the ends of the edges 4. Due to the resilience of the plastics material and of the rounded folded part 6, the legs 5 separate in the direction of the arrows F1 until the lock notches 51 engage under the edges of the support 3, while the base 10 abuts against the edges 4 of the support. Then, the resilience of the legs is free to act and the legs return to the locking position shown in FIG. 1.

Figure 2:
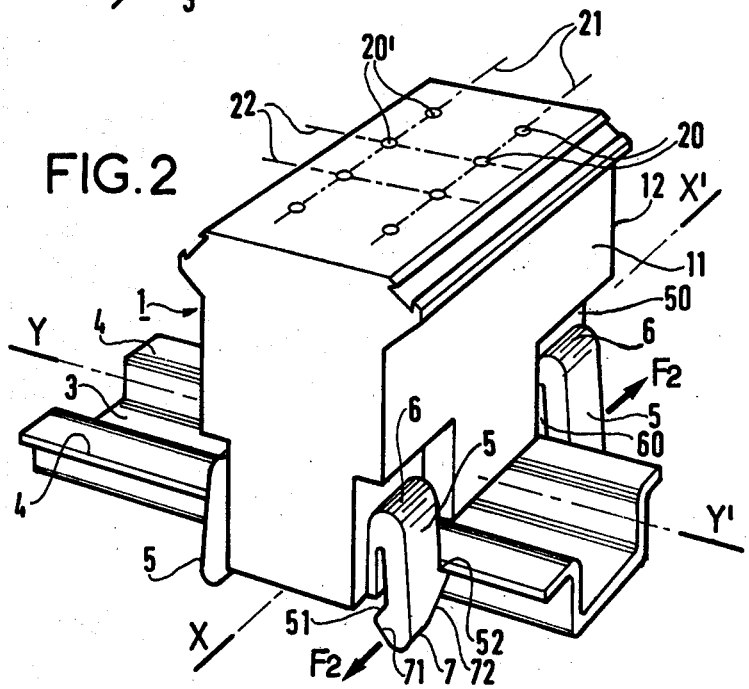
FIG. 2 is a schematic view of the junction block according to FIG. 1, for installation cross-wise on the support.

For the crosswise installation of the junction block, the base is disposed above the support 3, the longitudinal plane of symmetry about the line YY' being parallel to the edges 4. The block is then pushed onto support 3 so that the engaging ramps 72 come into contact with the edges 4. Due to the resilience of the plastics material along the rounded fold 6, the legs 5 separate in the direction of the arrows F2 until the lock notches 52 engage under the edges 4 of the support 3 while the base 10 abuts against the edges 4 of the support. Then the resilience of the legs is free to act and the legs return to the locking position shown in FIG. 2.

To remove the junction block from the support 3, opposed lateral force must be exerted on the junction block in the direction shown by the arrows, this causing the unlocking of the notches.

Due to the backed off position of the legs in the recesses 50, the blocks can be disposed side by side either in the longitudinal direction or in the transversal direction, one block being fixed independently from another without this leading to the connection bar thus constituted, taking up extra space.

It is obvious that the invention is in no way limited to the embodiment which has just been described and which has been given only by way of example; in particular, the invention can be applied to the longitudinal installation on one type of support and to the crosswise installation on another type of support depending on the extent to which the distance between the lock notches are different and adapted to the spacing of the edges of these types of support.

What I claim is:

1. A junction block having two orthogonal fixing orientations in relation to a support having parallel strip edges, each block comprising; a molding of plastics material including four resilient fixing legs integrally molded with the block and disposed symmetrically in pairs about both of the fixing orientations of the block, each leg being so configured and having two lock notches which face, respectively, the adjacent fixing legs, each one of said two lock notches on each leg facing a different one of the adjacent legs for movement of either one of said two lock notches on each leg under one of the edges of the support after resilient flexure away from said edge during pressure application of the block to the support to thereby retain said block on said support in a selected one of said orthogonal orientations.

2. A junction block according to claim 1, further comprising a stop facing each lock notch and disposed to bear against said edge of the support.

3. A junction block according to claim 2 wherein said stop comprises the base of the block.

4. A junction block according to claim 2, wherein said block includes opposite lateral surfaces and said fixing legs are recessed within the lateral surfaces of the junction block.

5. A junction block according to claim 2, wherein the ends of the fixing legs terminate beyond each of the lock notches in a support edge engaging ramp.

6. A junction block according to claim 1, wherein said block includes opposite lateral surfaces and said fixing legs are recessed within the lateral surfaces of the junction block.

7. A junction block according to claim 6, wherein the ends of the fixing legs terminate beyond each of the lock notches in a support edge engaging ramp.

8. A junction block according to claim 1, wherein the ends of the fixing legs terminate beyond each of the lock notches in a support edge engaging ramp.

* * * * *